United States Patent [19]

Nishikawa et al.

[11] 4,142,164

[45] Feb. 27, 1979

[54] DIELECTRIC RESONATOR OF IMPROVED TYPE

[75] Inventors: Toshio Nishikawa, Nagaokakyo; Youhei Ishikawa; Sadahiro Tamura, both of Kyoto, all of Japan

[73] Assignee: Murata Manufacturing Co., Ltd., Japan

[21] Appl. No.: 797,858

[22] Filed: May 17, 1977

[30] Foreign Application Priority Data

May 24, 1976 [JP] Japan ..... 51/66658

[51] Int. Cl.[2] ..... H01P 1/20; H01P 7/06

[52] U.S. Cl. ..... 333/73 W; 333/83 R; 333/83 A

[58] Field of Search ..... 333/8, 73 R, 73 C, 73 S, 333/73 W, 83 A, 83 R, 82

[56] References Cited

U.S. PATENT DOCUMENTS

| | | | |
|---|---|---|---|
| 3,696,314 | 10/1972 | Kell et al. | 333/73 W |
| 3,798,578 | 3/1974 | Konishi et al. | 333/83 T |
| 3,821,669 | 6/1974 | Wuerffel | 333/83 R |
| 3,913,039 | 10/1975 | Weiner | 333/73 R |
| 3,973,226 | 8/1976 | Affolter et al. | 333/73 W |
| 4,028,652 | 6/1977 | Wakino et al. | 333/83 A |

*Primary Examiner*—Alfred E. Smith
*Assistant Examiner*—Harry E. Barlow
*Attorney, Agent, or Firm*—Wenderoth, Lind & Ponack

[57] ABSTRACT

A dielectric resonator is made up of a block of dielectric material and a synthetic resin bonded onto the dielectric material for precisely adjusting the required resonance frequency of the resonator. The resonance frequency is reduced by an increase of the amount of synthetic resin and the resonance frequency is increased by a decrease of the mass of synthetic resin.

7 Claims, 8 Drawing Figures

DIELECTRIC RESONATOR OF IMPROVED TYPE

The present invention relates to a dielectric resonator and, more particularly, to a dielectric resonator for use in a microwave filter having means for precise adjustment of the resonance frequency.

It is well known that a microwave band-pass filter utilizes one or more resonators made of dielectric material. Conventionally, in the manufacture of a filter employing a dielectric resonator, the resonance frequency of each of the manufactured resonators made of dielectric material such as ceramics of titanium oxides is likely to have a certain degree, for example about one percent, of variation due to the undesirable variation of the size of the resonator. In order to eliminate the disadvantages as described above, various methods have heretofore been employed, one method of which is to provide a conductive material adjacent and over the dielectric material as is shown in FIG. 1.

Referring to FIG. 1, the prior art microwave filter employing one or more resonators, here shown as being three in number and indicated by A has, supports B for fixedly supporting thereon the respective resonators A and has a conductive material such as adjusting screw C over the respective resonators A. Upon turning a screw C, the resonance frequency of the corresponding resonator A is altered to match the required resonance frequency.

However, it has been found that the method described above has a disadvantage in that the screw may be turned from its adjusted position during the use of the filter by the application of an external force such as shaking or vibration, so that the resonance frequency set for the filter may undesirably vary.

Furthermore, the adjustment is successful only when the filter has the resonator fixedly mounted in the casing of the filter. In other words, the adjustment is effected by a combination of the resonator and the screw and the adjusted relation therebetween is maintained only when the resonator is fixed in the casing.

Accordingly, it is a primary object of the present invention to provide an improved dielectric resonator which, when used in a microwave filter, is capable of being adjusted so as to be set at a required resonance frequency without providing other components such as an adjusting screw in the filter.

It is another object of the present invention to provide an improved dielectric resonator of the above described type which has a simple construction and is stable during functioning, and can be manufactured at low cost.

In order to accomplish these and other objects, according to the present invention, there is employed a dielectric resonator which comprises a block of known dielectric material and at least one lump of synthetic resin made of dielectric material fixedly bonded on the resonator.

Since the mass of the synthetic resin is easier to adjust, that is, to increase or decrease the mass thereof, than that of the dielectric resonator itself, the adjustment of the resonance frequency of the dielectric resonator can be effected by the addition or removal of part of the synthetic resin from the resonator. After the synthetic resin has been placed on the resonator in the required amount, the resonator itself has the required resonance frequency. Accordingly, it is not necessary to adjust the resonance frequency of the resonator again. If it is necessary to change the resonance frequency of the resonator, this can be easily effected by the addition or removal of part of the resin from the resonator.

These and other objects and features of the present invention will become apparent from the following descriptions made in conjunction with preferred embodiments thereof with reference to the accompanying drawings, in which;

FIG. 3(*b*) is a sectional front view taken along the line III(*b*)—III(*b*) of FIG. 3(*a*)

Figure 3:
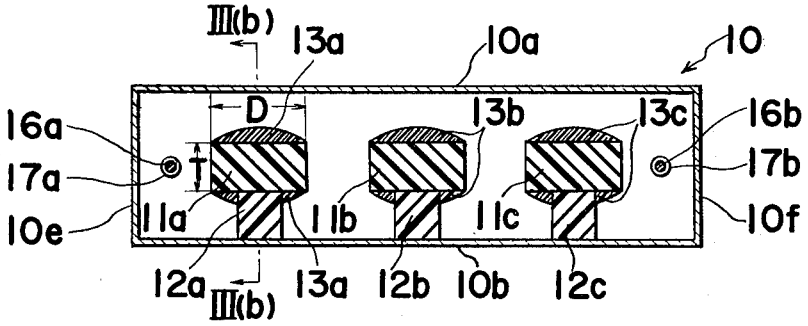
FIG. 3(*a*) is a sectional side view taken along the line III(*a*)—III(*a*) of FIG. 2.
Figure 3:
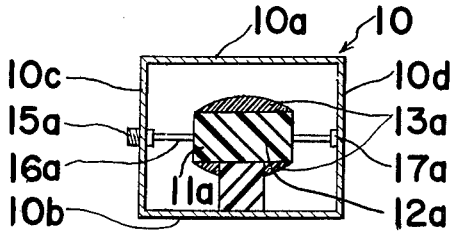
Figure 4:
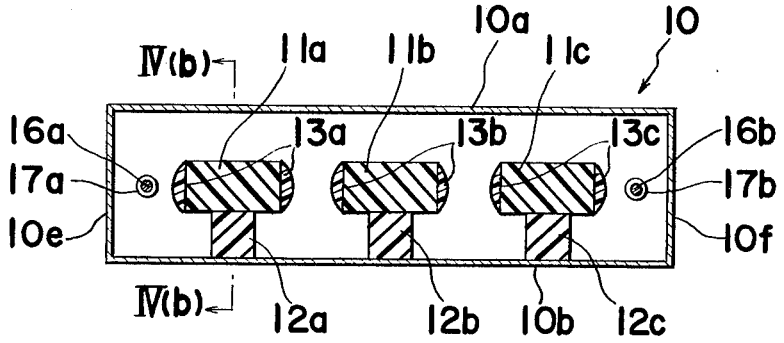
Figure 4:
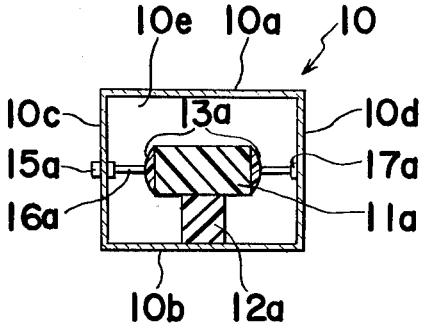
Figure 5:
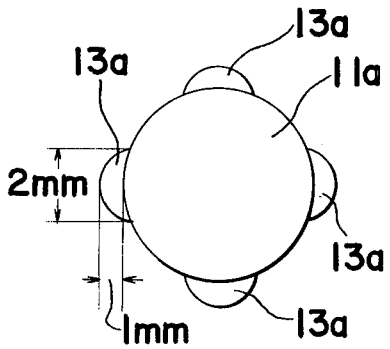
Figure 6:
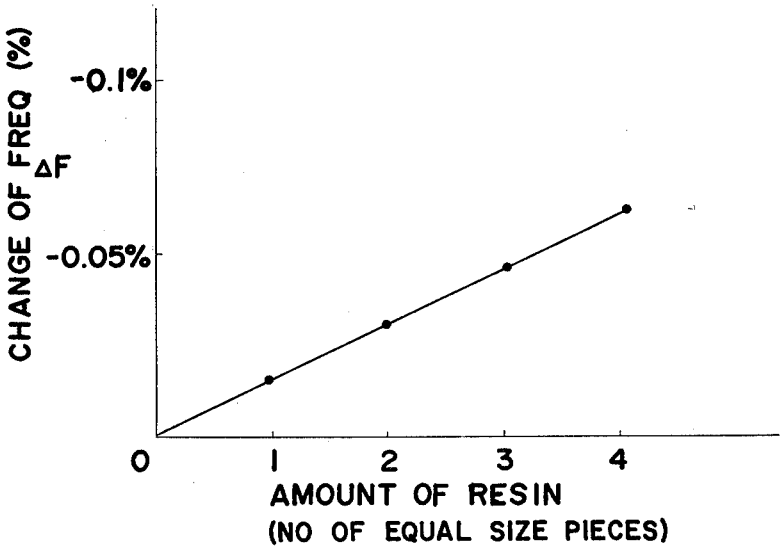

FIGS. 4(*a*) and 4(*b*) are views similar to FIGS. 3(*a*) and 3(*b*) but particularly showing a modification thereof;

FIG. 5 is a fragmentary top plan view of the dielectric resonator shown in FIGS. 3(*a*) and 3(*b*); and FIG. 6 is a graph showing the relation between the amount of synthetic resin and the degree of change of the resonance frequency.

Before the description of the present invention proceeds, it should be noted that like parts are designated by like reference numerals throughout the accompanying drawings.

Figure 1:
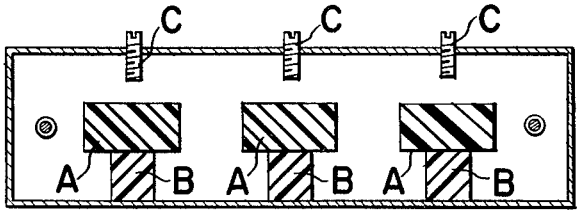
FIG. 1 PRIOR ART
FIG. 1 is a cross sectional view of a conventional microwave filter employing a dielectric resonator.
Figure 2:
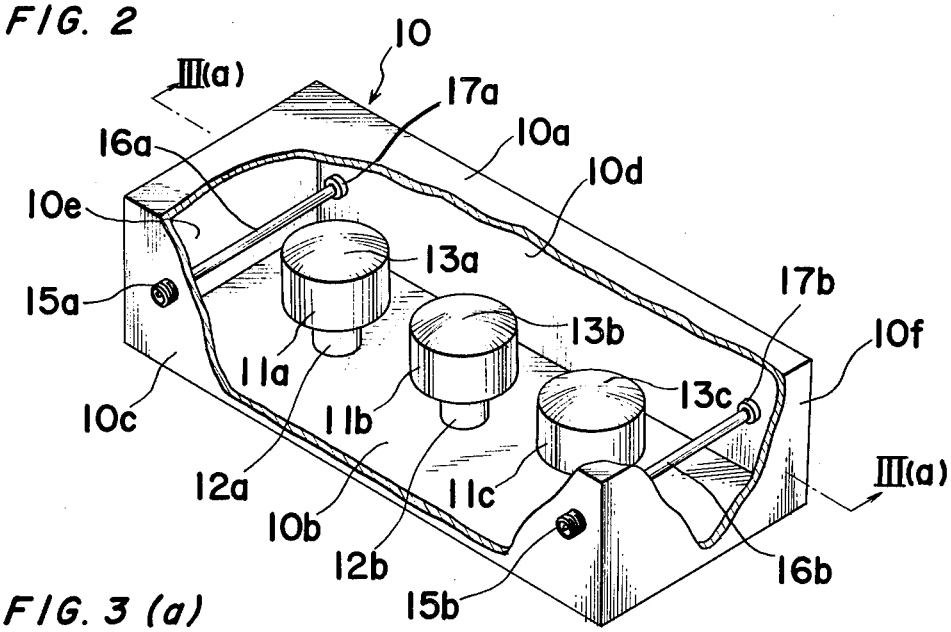
FIG. 2 is a perspective view, partly broken away, of a band-pass filter showing the arrangement of the dielectric resonator of the present invention.

Referring first to FIG. 2, a microwave band-pass filter is shown which comprises a casing 10, of substantially box-like configuration, made of any known metallic material such as brass, which casing 10 includes top and bottom walls 10*a* and 10*b*, a pair of opposed side walls 10*c* and 10*d* and a pair of end walls 10*e* and 10*f*. Although the walls 10*a* to 10*f* are shown as integrally formed by machining a rigid metal block, the walls may be formed by metallic plates with the neighboring walls being rigidly connected to each other, by the use of, for example, a plurality of screws.

Within the casing 10, one or more resonators, have shown as three in number and indicated by 11*a*, 11*b* and 11*c*, are mounted on the bottom wall 10*b* on respective supporting spacers 12*a*, 12*b* and 12*c* and arranged in a row in spaced and side-by-side relation with respect to each other. The supporting spacers 12*a* to 12*c* are made of any known electrically insulating material of relatively low dielectric constant. Each of the three cylindrical resonators 11*a*, 11*b* and 11*c* has a lump of synthetic resin, namely lumps 13*a*, 13*b* and 13*c* fixedly bonded onto the top and bottom flat surfaces thereof. The relation between the cylindrical resonators and the resin are described in detail later:

One of the side walls 10*c* is provided at respective portions adjacent to the ends thereof with couplers 15*a* and 15*b* for respective connection with coaxial cables for microwave input and output transmission lines (not shown). These couplers 15*a* and 15*b* have axial terminals which are respectively connected with rods or probes 16*a* and 16*b* made of either electrically conductive material or dielectric material. The probes 16*a* and 16*b* in the embodiment as shown in FIG. 2 extend in parallel relation to the end walls 10*e* and 10*f* and respectively between the end wall 10*e* and the end resonator 11*a* and between the end wall 10*f* and the end resonator 11*c*. The opposite ends of each of the probes 16*a* and 16*b*, from the corresponding coupler 15*a* or 15*b*, are supported by the opposed side wall 10*d* by means of mounting pieces 17*a* and 17*b* made of electrically insulating material such as polytetrafluoroethylene. The dimension of the casing 10, particularly of the inside thereof is a certain size so as to have a predetermined cutoff frequency.

With particular reference to FIGS. 3(*a*) and 3(*b*), there are shown details of the dielectric resonators 11*a*, 11*b* and 11*c* according to the present invention. The description hereinbelow is particularly directed to the first resonator 11*a* provided at leftmost side as viewed in FIG. 2. However, it is to be noted that other resonators 11*b* and 11*c* are formed in the same manner and have the same structure as the resonator 11*a*. The dielectric resonator 11*a* is made of a cylindrical block of any known dielectric material such as ceramics of titanium oxides while the resin 13*a* to be bonded onto the top and the bottom flat surface thereof is also made of dielectric material such as an epoxy resin type bonding agent. The dimension of the dielectric cylindrical block is such that the diameter D thereof is a few centimeters, for example, in one type 1.45cm, the thickness T thereof is about 0.4 times the size of the diameter D and is determined by the resonance frequency. The resonator as described above is fixedly bonded onto the cylindrical supporting spacer 12*a* which is in turn fixedly bonded onto the bottom wall 10*b*. The reason for providing such resin is described hereinbelow.

Before providing the resin, the cylindrical resonator itself is chosen to have a resonance frequency slightly higher than the required resonance frequency. By bonding a necessary amount of resin the cylindrical resonator, the resonance frequency thereof is decreased so as to match the desired frequency. Since the resin is easier to process than the dielectric material, it is easy to adjust the resonance frequency of the resonator to match the required resonance frequency. For example, when it is required to increase the resonance frequency, one may pare off or cut off excess resin bonded onto the cylindrical resonator, while, on the other hand, when it is required to decrease the resonance frequency, one may further add the necessary resin. The amount of resin to be bonded onto the resonator is determined by the percentage decrease of the frequency. One example of a decrease of the resonance frequency, in relation to the amount of the resin, will be given in connection with a resonator shown in FIGS. 4(*a*) to 5.

Referring to FIGS. 4(*a*) and 4(*b*), there is shown a modification of the resonator described above, in which the resin 13*a*, described above as being provided on the top and bottom of the flat surface of the cylindrical resonator, is provided on the curved side surface of the resonator at four positions equally spaced from each other. The top plan view of the resonator in FIG. 5 shows more clearly the manner in which the resin is provided.

According to the tests carried out by the inventors, the cylindrical resonator used for this particular embodiment has a diameter of 6mm, a thickness of 2.4mm and a dielectric constant $\epsilon$ of 3.5. Accordingly, the cylindrical resonator constructed for this embodiment has a resonance frequency of 10GHz. Each of the four pieces of resin 13*a* has a thickness of the thickest part of 1mm, and extends around the curved surface; a distance of 2mm. The dielectric constant $\epsilon$ of the resin 13*a* used for this embodiment is 4.0. When the four pieces of the resins are provided, the percentage decrease of the resonance frequency is approximately 0.065%, and when one piece thereof is removed, the percentage decrease of the resonance frequency is approximately 0.05%. Such relation is shown in FIG. 6, in which the abscissa and the ordinate represent the number of pieces of the resin and the percentage decrease of the resonance frequency. As is apparent from the graph, the relation is such that the decrease in frequency is directly proportional to the amount of resin bonded onto the cylindrical resonator. It is to be noted that the amount of resin to be added to or to be removed from the cylindrical resonator is not necessarily all from one piece of the resin but can be any small amount needed, so that it is possible to control the resonance frequency to a precise degree.

It should be noted that the resin may be blended with particles of dielectric material, suitably of dielectric material used for constructing the cylindrical resonator, for increasing the degree of change of the resonance frequency with respect to the amount of the resin.

It should also be noted that the temperature coefficient of the resin and/or the particles of dielectric material may be such as to give a different temperature coefficient to the resonator for improving the temperature characteristics of the resonator.

Although the present invention has been fully described by way of example in connection with the preferred embodiment thereof, it should be noted that various changes and modifications will be apparent to those skilled in the art. By way of example, the resonator according to the present invention can be used not only in the microwave band-pass filter referred to above, but also in any other microwave filters such as microstrip filters and waveguide filters which employ dielectric resonators therein. In addition, even in the embodiment shown in any of FIGS. 1 to 4, the dielectric resonator may be modified to have any other form such as cubic, or to have an aperture formed therein. Furthermore, the dielectric resonator may be so altered as to have the resin bonded onto any desired place around the resonator. Therefore, unless otherwise such changes and modifications depart from the scope of the present invention, they should be construed as being included therein.

What is claimed is:

1. A dielectric resonator structure for use in a resonator, which comprises: a block of dielectric material; a support of dielectric material a bonding material bonding said block to said support; and, in addition to said bonding material, a mass of synthetic resin essentially of dielectric material bonded onto said block of dielectric material for precisely adjusting the resonance frequency of the block of dielectric material, whereby the resonance frequency can be decreased by an increase of the mass of synthetic resin and the resonance frequency can be increased by an decrease of the mass of synthetic resin.

2. A dielectric resonator structure as claimed in claim 1, wherein said block of dielectric material is a ceramic essentially of titanium oxides.

3. A dielectric resonator structure as claimed in claim 1, wherein said synthetic resin is blended with particles of dielectric material.

4. A dielectric resonator structure as claimed in claim 3, wherein said particles of dielectric material are the same material as the material of said block of dielectric material.

5. A dielectric resonator structure as claimed in claim 1, wherein said block of dielectric material is in the shape of a disk.

6. A dielectric resonator structure as claimed in claim 5, wherein said synthetic resin is bonded onto at least one of the opposite flat surfaces of said disk.

7. A dielectric resonator structure as claimed in claim 5, wherein said synthetic resin is bonded onto the curved peripheral surface of said disk.

* * * * *